US007972545B2

(12) United States Patent
Bae

(10) Patent No.: US 7,972,545 B2
(45) Date of Patent: Jul. 5, 2011

(54) DEVICE AND METHOD FOR MANUFACTURING END MILL

(75) Inventor: Byung Gyun Bae, Daegu (KR)

(73) Assignee: TaeguTec, Ltd., Daegu (KR)

( * ) Notice: Subject to any disclaimer, the term of this patent is extended or adjusted under 35 U.S.C. 154(b) by 31 days.

(21) Appl. No.: 12/664,134

(22) PCT Filed: Jun. 11, 2007

(86) PCT No.: PCT/KR2007/002807

§ 371 (c)(1),
(2), (4) Date: Dec. 11, 2009

(87) PCT Pub. No.: WO2008/153227

PCT Pub. Date: Dec. 18, 2008

(65) Prior Publication Data

US 2010/0181694 A1 Jul. 22, 2010

(51) Int. Cl.
*B29C 43/02* (2006.01)

(52) U.S. Cl. ..... 264/123; 264/109; 264/125; 419/38; 419/66; 425/78; 425/346; 425/352

(58) Field of Classification Search ..... None
See application file for complete search history.

(56) References Cited

U.S. PATENT DOCUMENTS 7,560,068 B2 * 7/2009 Smilovici et al. ..... 419/38

FOREIGN PATENT DOCUMENTS

| | | |
|---|---|---|
| JP | 59-166601 | 9/1984 |
| JP | 62-211304 | 9/1987 |
| JP | 63-250404 | 10/1988 |
| JP | 2007-211259 | 8/2007 |
| SU | 954183 | 8/1982 |
| SU | 1252046 | 8/1986 |

OTHER PUBLICATIONS

International Search Report in PCT/KR2007/002807, dated Mar. 6, 2008.
Written Opinion in PCT/KR2007/002807, dated Mar. 6, 2008.
Decision on Grant for Russian Application No. 2009149706, dated Mar. 24, 2011.

* cited by examiner

*Primary Examiner* — Mary Lynn F Theisen
(74) *Attorney, Agent, or Firm* — Womble Carlyle

(57) ABSTRACT

A device and a method for manufacturing an end mill in which the amount of grinding of a blank end mill is small. The device for manufacturing an end mill includes: upper and lower punches; a die; a feed box for supplying a powder of material for the end mill; and a cleaner for eliminating the powder from a top surface of the die. The upper and lower punches are movable up and down relative to each other and have a lengthwise molding cavity formed thereon. The die has a penetrating slit sized to be approximated to the width of the upper and lower punches. The penetrating slit allows the up-and-down movements of the upper and lower punches. The feed box supplies the powder into a space formed by the wall of the penetrating slit and the lower punch.

6 Claims, 5 Drawing Sheets

DEVICE AND METHOD FOR MANUFACTURING END MILL

TECHNICAL FIELD

The present invention generally relates to a device and a method for manufacturing an end mill, and more particularly to a device and a method for manufacturing an end mill through compression molding.

BACKGROUND ART

In order to manufacture an end mill from a material having low formability and high hardness (e.g., hardmetal cemented carbide), there already exists a technique which manufactures an end mill product by the following steps: molding a powder of material for an end mill into a rod shape through extrusion molding; sintering a molded body to form a blank end mill; and grinding the blank end mill to have a predetermined shape.

However, in the above technique, the amount of materials to be grinded is quite large since a blank end mill having a simple rod shape is grinded to have a cutting portion. As a result, there is a problem in that it takes much time to perform a grinding process and the material for an end mill is unnecessarily wasted.

SUMMARY OF THE INVENTION

It is an object of the present invention to provide a device and a method for manufacturing an end mill, wherein a grinding amount of a blank end mill is small, thereby solving the aforementioned problem of the prior art.

In order to achieve the above object, a device for manufacturing an end mill of the present invention comprises upper and lower punches, a die, a means for supplying a powder of material for the end mill and a means for eliminating the powder from the top surface of the die. The upper and lower punches are movable up and down relative to each other and have a lengthwise molding cavity formed thereon. The die has a penetrating slit sized to be approximated to the width of the upper and lower punches. The penetrating slit allows up-and-down movements of the upper and lower punches. A level of a top surface of the die is configured such that a ratio of a height of a portion for forming the shank portion of the end mill to a height of a portion for forming the cutting portion of the end mill within a space formed by a wall of the penetrating slit and the lower punch corresponds to a ratio of a height of the shank portion of the end mill to a height of the cutting portion of the end mill after molding. The means for supplying a powder of material for the end mill supplies the powder into the space formed by the wall of the penetrating slit and the lower punch.

The means for eliminating the powder from the top surface of the die may include a means for sweeping down the powder which is overfilled within the space formed by the wall of the penetrating slit and the lower punch. This adjusts a level of the powder to the level of the top surface of the die.

Further, according to the present invention, a cross section vertical to a portion of the lengthwise molding cavity of the upper and lower punches has a semispherical-shaped cavity. Side end portions of the cavity have a radius of curvature (r) different from a radius of curvature (R) of the cavity. A center of the radius of curvature (r) is located outside of the cavity and below a top end thereof.

Moreover, the present invention provides a method of manufacturing an end mill, which is capable of achieving the above object.

The method of the present invention provides a molding device including the upper and lower punches and the die as described above. In addition, the present method comprises the steps of: supplying a powder of material for the end mill into the space formed by a wall of the penetrating slit and the lower punch; eliminating the powder from the top surface of the die; and compression-molding the powder filled in the space by a relative movement of the upper and lower punches.

BEST MODE FOR CARRYING OUT THE INVENTION

Embodiments of the present invention will now be exemplarily described with reference to the accompanying drawings so that the present invention can be more easily understood and it can be clearly figured out how it would be implemented.

Figure 1:
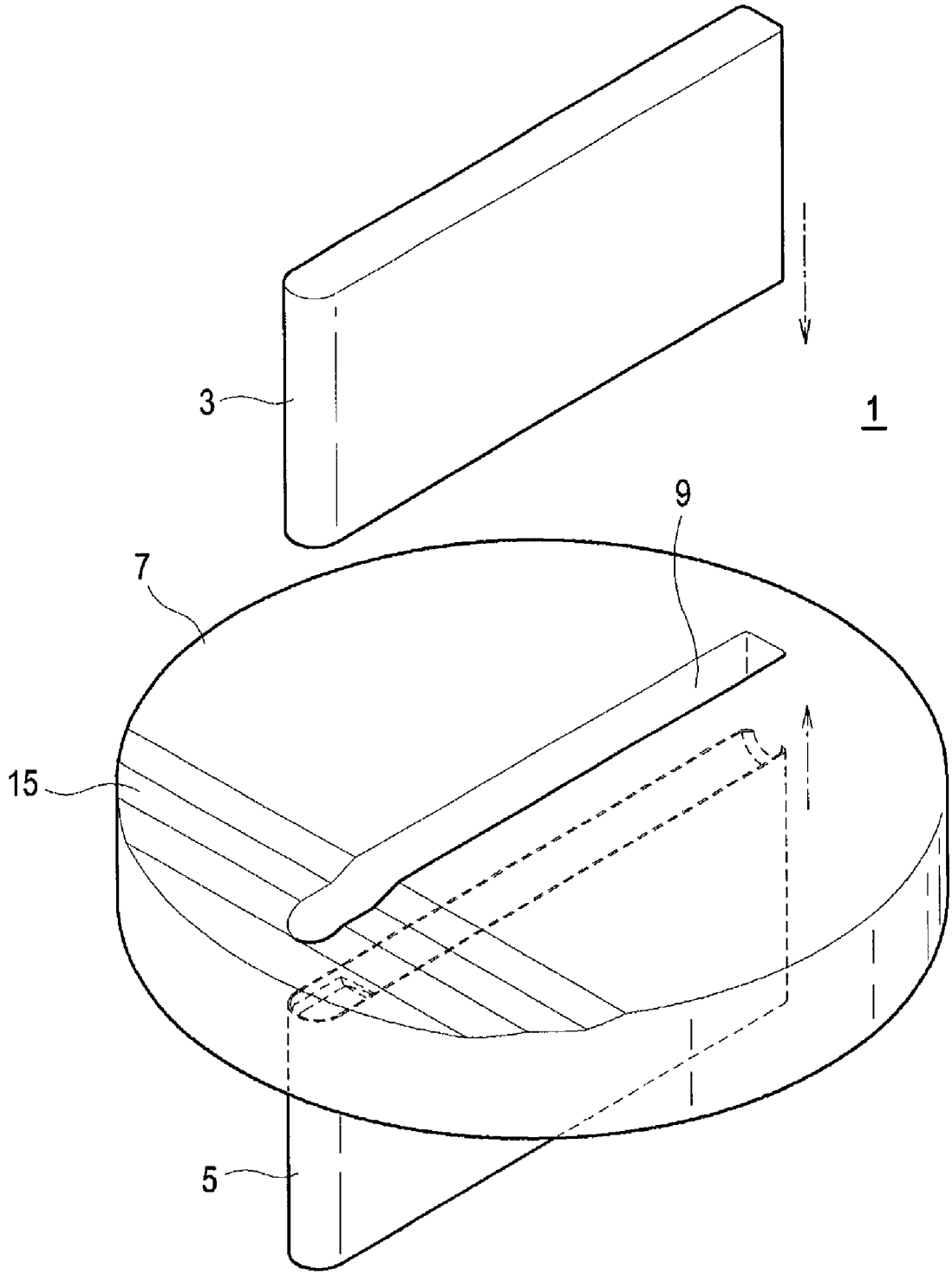
FIG. 1 is a perspective view of a molding device used for manufacturing an end mill in accordance with the present invention.

FIG. 1 shows a molding device 1 used for manufacturing an end mill according to the present invention. The end mill molding device 1 comprises an upper punch 3, a lower punch 5 and a die 7. The upper punch 3 and the lower punch 5 have a generally rectangular parallelepiped shape with a thin width. Such punches 3 and 5 are movable up and down relative to each other. A bottom of the upper punch 3 and a top of the lower punch 5 are formed with a lengthwise molding cavity. The die 7 has an elongated penetrating slit 9 therethrough. The penetrating slit 9 is slightly wider than widths of the upper punch 3 and the lower punch 5 to thereby allow the up-and-down movements of the upper punch 3 and the lower punch 5. When the upper punch 3 and the lower punch 5 are relatively moved and thus become close to each other for compression molding, a space formed therebetween is similar to a shape of an end mill product.

As shown in FIG. 1, a top surface of the die 7 adjacent to one end of the penetrating slit 9 is formed with a downward stepped portion 15, which has a level lower than that of the top surface of the die 7 adjacent to the other end of the penetrating slit 9. More concretely, the top surface of the die 7 is formed such that a ratio of a height of a portion for forming a shank portion of an end mill to a height of a section for forming a cutting portion of an end mill within a space formed by a wall of the penetrating slit 9 and the lower punch 5 corresponds to a ratio of a height of a shank portion of an end mill to a height of a cutting portion of an end mill after molding.

Figure 3:
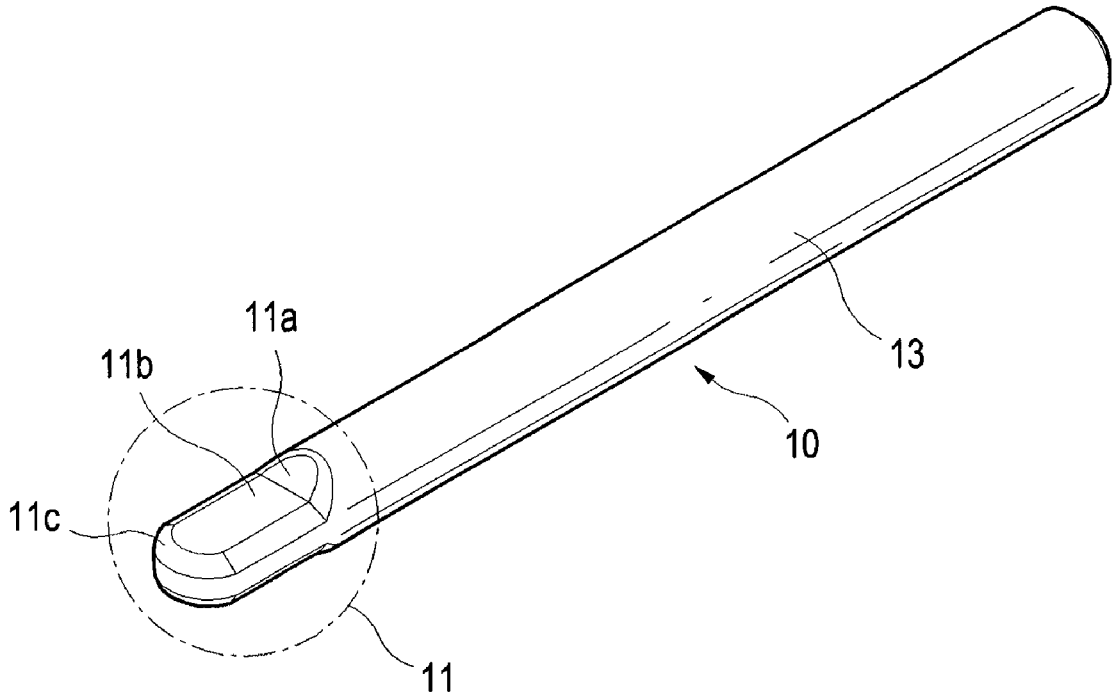
FIG. 3 is a perspective view of an end mill formed through compression molding by the molding device used for manufacturing an end mill in accordance with the present invention.

FIG. 3 shows a compression-molded end mill 10 according to an embodiment of the present invention. As shown in FIG. 3, the end mill 10 has a generally rod-shaped shank portion 13 and a cutting portion 11 thinner than the shank portion 13. Further, the cutting portion 11 includes a first slope portion 11*a*, a flat portion 11*b* and a second slope portion 11*c*. The end mill 10 after compression molding is shaped similarly to a shape of a finished end mill product as a whole.

The top surface of the die 7 shown in FIG. 1 is adapted to mold such an end mill 10. As shown in FIG. 3, the cutting portion 11 of the end mill 10 is formed with a stepped portion including a first slope portion 11*a*, a flat portion 11*b* and a second slope portion 11*c*. The downward stepped portion 15 is formed on the top surface of the die 7 such that the ratio of a height of the portion for forming the shank portion 13 of an end mill to a height of the section for forming the cutting portion 11 of an end mill within the space formed by the wall of the penetrating slit 9 and the lower punch 5 corresponds to the ratio of the height of the shank portion 13 to the height of the cutting portion 11 of the end mill after molding. That is, the downward stepped portion 15 on the top surface of the die 7 corresponds to the cutting portion 11 of the end mill.

A portion of the top surface of the die 7, which corresponds to the cutting portion 11 of the end mill, is not limited to the downward stepped portion 15. If the above-described ratio condition is satisfied, then it can be variously embodied according to a shape of the cutting portion 11 of the end mill.

The molding device shown in FIG. 1 further comprises a means for supplying a powder, such as a feed box, and a means for eliminating the powder, such as a cleaner. The feed box supplies a powder of material for an end mill into the space defined by the wall of the penetrating slit 9 and the lower punch 5. Further, cleaner serves to sweep down the powder overfilled in the space defined by the wall of the penetrating slit 9 and the lower punch 5 to thereby adjust a level of the powder to a level of the top surface of the die 7.

Hereinafter, a method of manufacturing an end mill according to the present invention will be described by way of an exemplary embodiment.

As shown in FIG. 1, in order to manufacture an end mill, the lower punch 5 penetrates into the penetrating slit 9 of the die 7 and stops at an appropriate level below the level of the top surface of die 7. Thus, a molding space, which is surrounded by the wall of the penetrating slit 9 of the die 7 and the lower punch 5, is formed. Subsequently, a mixed powder having a powder of material for a molded body and a bonding agent such as wax is supplied into the space. The mixed powder must be overfilled higher than the level of the top surface of the die 7. Such an overfilled powder is swept down by a cleaner which eliminates powder in conformity with the level of the top surface. As such, the mixed powder, which is in the downward stepped portion 15 of the top surface of the die 7, is flush with the downward stepped portion 15.

Subsequently, compression molding begins while the upper punch 3 is lowered. Preferably, the lower punch 5 is slightly lowered in advance prior to lowering the upper punch 3 so that the powder filled up to the level of the top surface of the die 7 does not flow out due to the contact with the upper punch 3. It is preferable that the upper punch 3 and the lower punch 5 become close to each other by about 1 mm instead of complete contact therebetween in order to prevent them from damaging each other. In such a close state as described above, a space formed between the upper punch 3 and the lower punch 5 is similar to a shape of an end mill product.

Figure 2:
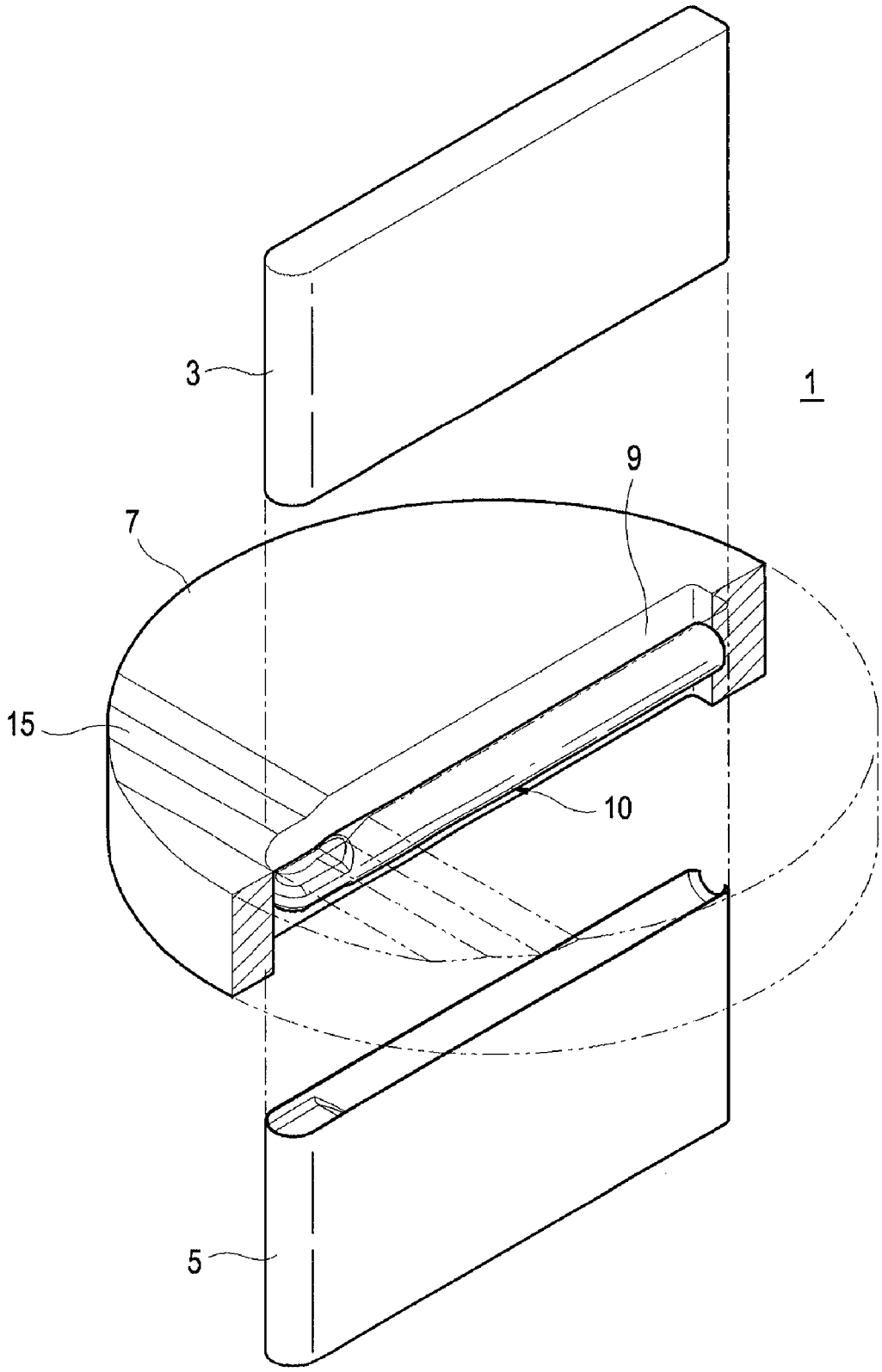
FIG. 2 is an exploded perspective view of a molding device used for manufacturing an end mill in accordance with the present invention.

FIG. 2 shows the molding device 1 shown in FIG. 1 and the end mill 10 after compression molding shown in FIG. 3 together. This is so that a compression molding process in accordance with the present invention can be more easily understood. In FIG. 2, for ease of understanding, a half of the die 7 is cut away about the penetrating slit 9 and the upper punch 3 and the lower punch 5 are spaced apart from the die 5.

After compression molding, the upper punch 3 is raised and the lower punch 5 with the molded body lying thereon is also raised to the extent that the molded body can be exposed above the level of the top surface of the die 7. The molded body on the lower punch 5 is moved into a sintering furnace by any appropriate moving means so that it is subjected to a sintering process. As the molded body undergoes the sintering process, it becomes hard and forms a blank end mill. Such a blank end mill, which is similar to a shape of a finished end mill product, is made into a finished end mill product by grinding with a small amount.

According to the above-described device and method for manufacturing an end mill, a grinding amount of the blank end mill can be remarkably reduced. Moreover, it is possible to ensure uniform contraction when sintering the molded body.

Since the molded body is generally exposed to a high temperature environment during sintering, an ingredient such as wax is extracted from the molded body. As a result, the size of the molded body after sintering is entirely diminished compared to the molded body before sintering. In such a case, there is a problem in that the molded body is deformed partially or entirely when a contraction rate of the molded body is non-uniform. Accordingly, a technique, which can uniformly contract the molded body, is needed so as not to deform the molded body during the sintering process.

The nonuniform contraction of the molded body can occur because pressure is nonuniformly applied during compression molding. Thus, the density of the powder of material for an end mill or the density of the ingredient such as wax becomes nonuniform through the entire molded body. That is, if the density of the ingredient such as wax is nonuniform in the molded body, then the amount of the ingredient such as wax coming out during the sintering is different at each part of the molded body, thereby causing nonuniform contraction of the molded body.

According to the present invention, in the molding device 1, the downward stepped portion 15 is formed on the top surface of the die 7, which corresponds to the cutting portion 11 of an end mill. Further, when the powder is filled into the space formed by the wall of the penetrating slit 9 of the die 7 and the lower punch 5, the powder is filled up to the level of the top surface including the downward stepped portion. Thus, a relatively small amount of the powder is filled into a portion of the space for forming the thin cutting portion 11 of an end mill. Accordingly, a substantially uniform pressure is applied throughout the entire molded body during compression molding. In addition, such applying uniform pressure can uniformly maintain the density of the powder of material for an end mill or the density of the ingredient such as wax in the molded body. Thus, the molded body is uniformly contracted during sintering and is prevented from deforming.

Figure 4:
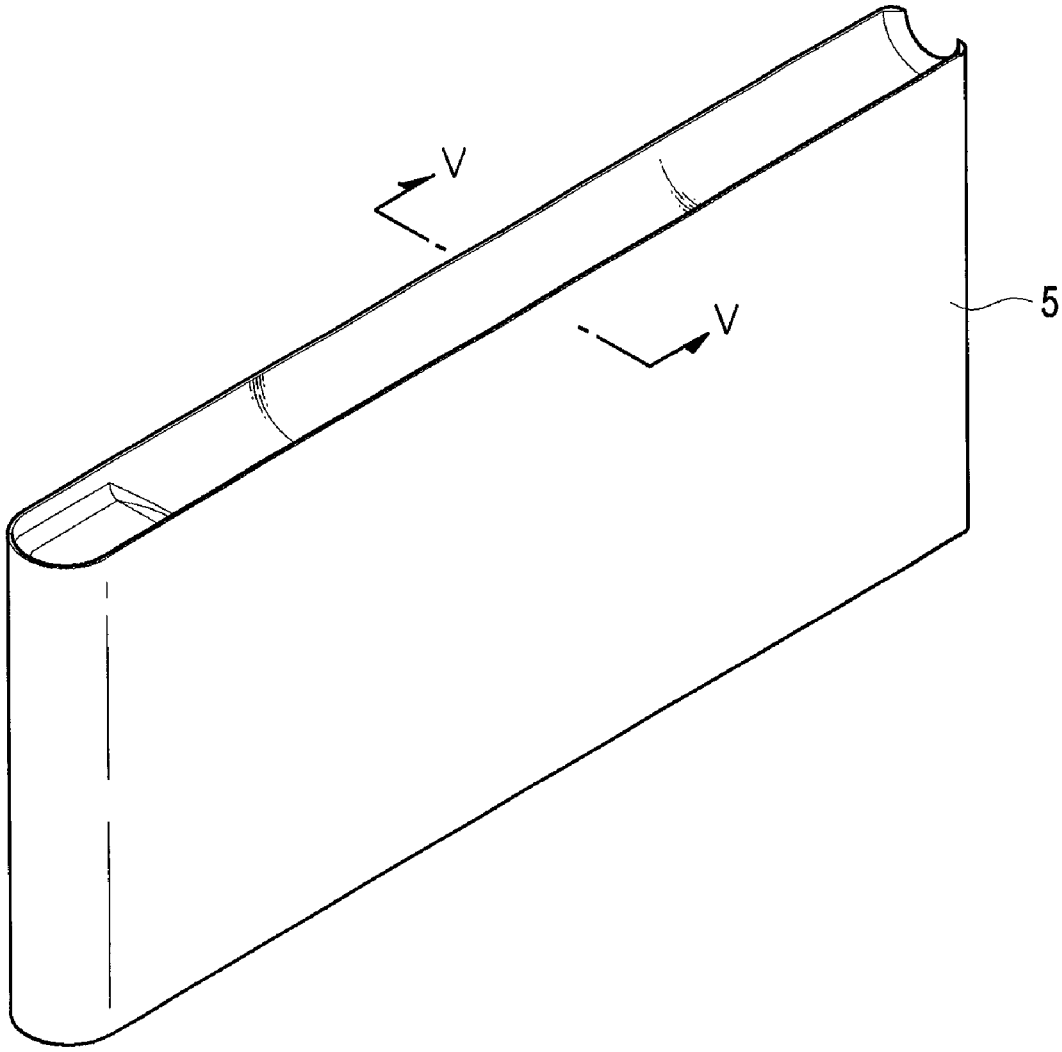
FIG. 4 is a perspective view of a lower punch shown in FIG. 1.
Figure 5:
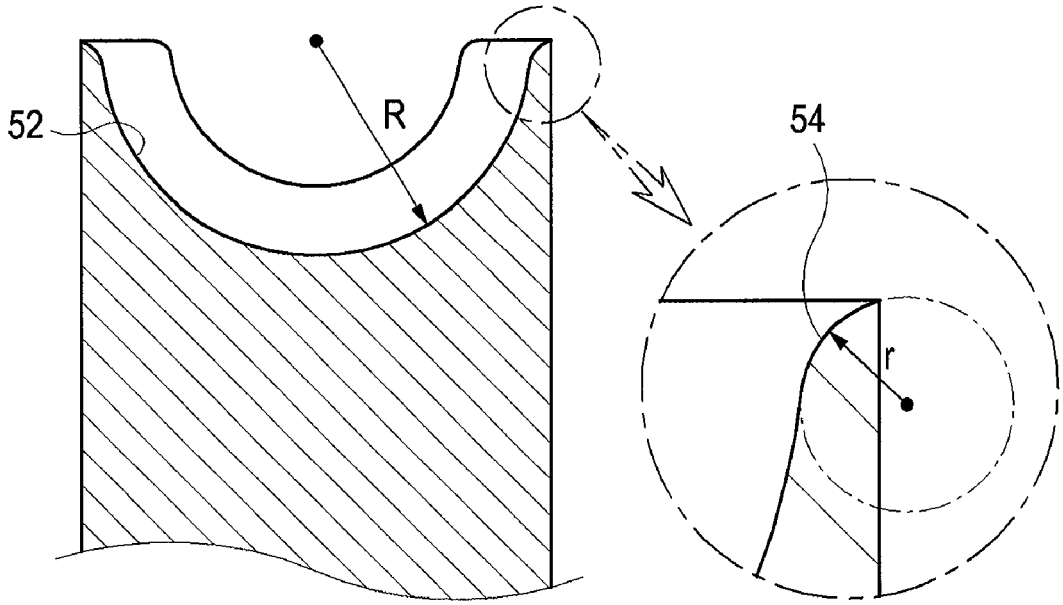
FIG. 5 is a cross-sectional view of the lower punch shown in FIG. 4, which is taken along the line V-V.

FIG. 4 shows the lower punch 5 of the molding device 1 according to the present invention. FIG. 5 shows a cross-section of the lower punch, which is taken along the line V-V shown in FIG. 4. As shown in FIG. 5, the lower punch 5 has a semispherical-shaped cavity 52. Further, both side end portions 54 of the cavity 52 have a radius of curvature r different from a radius of curvature R of the cavity 52. A center of the radius of curvature r is located outside of the cavity 52 and below a top end thereof.

Preferably, when the radius of curvature R of the cavity 52 is in a range of 5~10 mm, the radius of curvature r of the both side end portions 54 is in a range of about 0.4~0.5 mm.

Further, it is preferable that when the radius of curvature R of the cavity 52 is in a range of 5~10 mm, a width of the lower punch 5 is in a range of about 10.3~20.3 mm. According to the present invention, since the upper punch is configured symmetrically to the lower punch, the descriptions on the shape of the upper punch are omitted herein.

Further, the upper punch 3 and the lower punch 5 become close to each other only up to a position where they are spaced apart by about 1 mm. This is to prevent any damage which can be caused due to contacting each other. As a result, both lateral portions of the compression-molded body are formed with flashes. These flashes, which are unnecessary to an end mill, are eliminated by grinding.

According to the above-described structure of the lower punch 5, the cross-sectional shape of the molded body can be formed to be as circular as possible so that grinding with a small amount is possible. Further, since both side end portions of the upper and lower punches are reinforced, a device for manufacturing an end mill having a superior durability can be provided. In other words, the lower punch 5 is configured such that both side end portions 54 have stiffness by increasing their thicknesses to some extent while a flash to be grinded is sized to be as small as possible.

While the present invention has been particularly shown and described with reference to exemplary embodiments thereof, it will be understood by those of ordinary skill in the art that various alternations or modifications may be made without departing from the scope of the present invention.

The present invention provides a device and a method for manufacturing an end mill, which can manufacture an end mill through grinding with a small amount by manufacturing a blank end mill that is shaped similarly to an end mill product.

The invention claimed is:

1. A device for manufacturing an end mill wherein a cutting portion having cutting edges extends at one end portion of an elongated shank portion, comprising:

an upper punch and a lower punch configured to move up and down relative to each other and having a lengthwise molding cavity formed thereon;

a die having a penetrating slit sized to be approximated to a width of the upper and lower punches and allowing up-and-down movements of the upper and lower punches, wherein a level of a top surface of the die is configured such that a ratio of a height of a portion for forming the shank portion of the end mill to a height of a portion for forming the cutting portion of the end mill within a space formed by a wall of the penetrating slit and the lower punch corresponds to a ratio of a height of the shank portion of the end mill to a height of the cutting portion of the end mill after molding;

a feed box configured to supply a powder of material for the end mill into the space formed by the wall of the penetrating slit and the lower punch; and a cleaner configured to remove powder from the top surface of the die.

2. The device of claim 1, wherein the cleaner is configured to sweep down the powder overfilled in the space formed by the wall of the penetrating slit and the lower punch to thereby adjust a level of the powder to the level of the top surface of the die.

3. The device of claim 1, wherein a cross section vertical to a portion of the lengthwise molding cavity of the upper and lower punches has a semispherical-shaped cavity, wherein side end portions of the cavity have a radius of curvature (r) different from a radius of curvature (R) of the cavity, and wherein a center of the radius of curvature (r) is located outside of the cavity and below a top end thereof.

4. A device for manufacturing an end mill wherein a cutting portion having cutting edges extends at one end portion of an elongated shank portion, comprising:

an upper punch and a lower punch configured to move up and down relative to each other and having a lengthwise molding cavity formed thereon, the upper and lower punches having a rectangular parallelepiped shape with a thin width;

a die having a penetrating slit sized to be approximated to a width of the upper and lower punches and allowing up-and-down movements of the upper and lower punches, wherein a level of a top surface of the die at one end portion of the penetrating slit is lower than that of a top surface of the die at the other end portion of the penetrating slit, wherein the level of the top surface is lowered such that a ratio of a height of a portion for forming the shank portion of the end mill to a height of a portion for forming the cutting portion of the end mill within a space formed by a wall of the penetrating slit and the lower punch corresponds to a ratio of the height of the shank portion of the end mill to a height of the cutting portion of the end mill after molding;

a feed box configured to supply a powder of material for the end mill into the space formed by the wall of the penetrating slit and the lower punch; and a cleaner configured to remove powder by sweeping down the powder overfilled in the space formed by the wall of the penetrating slit and the lower punch to thereby adjust a level of the powder to the level of the top surface of the die.

5. A method of manufacturing an end mill wherein a cutting portion having cutting edges extends at one end portion of an elongated shank portion, comprising:

providing a molding device including: an upper punch and a lower punch configured to move up and down relative to each other and having a lengthwise molding cavity formed thereon; and a die having a penetrating slit sized to be approximated to a width of the upper and lower punches and allowing up-and-down movements of the upper and lower punches; wherein a level of a top surface of the die is configured such that a ratio of a height of a portion for forming the shank portion of the end mill to a height of a portion for forming the cutting portion of the end mill within a space formed by a wall of the penetrating slit and the lower punch corresponds to a ratio of a height of the shank portion of the end mill to a height of the cutting portion of the end mill after molding;

supplying a powder of material for the end mill into the space formed by the wall of the penetrating slit and the lower punch;

eliminating the powder from the top surface of the die; and compression-molding the powder filled in the space by a relative movement of the upper and lower punches.

6. The device of claim 2, wherein a cross section vertical to a portion of the lengthwise molding cavity of the upper and lower punches has a semispherical-shaped cavity, wherein side end portions of the cavity have a radius of curvature (r) different from a radius of curvature (R) of the cavity, and wherein a center of the radius of curvature (r) is located outside of the cavity and below a top end thereof.

* * * * *